US009924270B2

(12) United States Patent
Shanmugam et al.

(10) Patent No.: US 9,924,270 B2
(45) Date of Patent: Mar. 20, 2018

(54) TECHNIQUES FOR CHANNELIZATION OF STEREO AUDIO IN HEADPHONES

(71) Applicant: INTEL CORPORATION, Santa Clara, CA (US)

(72) Inventors: Rajeev Rema Shanmugam, Bangalore (IN); Gopinath Kandasamy, Bangalore (IN)

(73) Assignee: INTEL CORPORATION, Santa Clara, CA (US)

( * ) Notice: Subject to any disclaimer, the term of this patent is extended or adjusted under 35 U.S.C. 154(b) by 204 days.

(21) Appl. No.: 14/593,516

(22) Filed: Jan. 9, 2015

(65) Prior Publication Data

US 2016/0205475 A1 Jul. 14, 2016

(51) Int. Cl.
*H04R 5/033* (2006.01)
*H04R 5/04* (2006.01)
*H04R 1/10* (2006.01)

(52) U.S. Cl.
CPC ..... *H04R 5/033* (2013.01); *H04R 1/1041* (2013.01); *H04R 5/04* (2013.01)

(58) Field of Classification Search
CPC ..... H04R 5/033; H04R 5/04; H04R 1/1041; H04S 7/30
USPC ..... 381/309, 74
See application file for complete search history.

(56) References Cited

U.S. PATENT DOCUMENTS

2009/0007188 A1* 1/2009 Omernick ..... H04N 21/2402 725/62
2010/0020982 A1* 1/2010 Brown ..... H03G 3/20 381/74
2013/0279724 A1* 10/2013 Stafford ..... H04R 1/1041 381/309

* cited by examiner

*Primary Examiner* — David Ton
(74) *Attorney, Agent, or Firm* — Finch & Maloney PLLC

(57) ABSTRACT

Techniques are provided for automatically channelizing a stereo audio signal in a headphone device such that a correct audio channel is output to a user's ear regardless of which ear an earbud is inserted. In an embodiment, at least one earbud is configured with a sensor arranged on a housing of the earbud. The placement of the sensor can be keyed or otherwise positioned to identify a right or left ear based on proximity/contact with certain anatomy of the ear. For instance, the sensor can be in detectable range of ear anatomy such as a tragus/antitragus when inserted in one ear and outside of detectable range of the same when inserted in the other. By automatically detecting which ear an earbud has been inserted, audio channels can be switched as necessary enabling users to insert earbuds without regard for which is a right earbud and which is a left earbud.

20 Claims, 4 Drawing Sheets

| Sensor | Switch Position |
|---|---|
| Not triggered | 1 (default) |
| Triggered | 2 (switched) |

| Sensor | Switch Position |
|---|---|
| Not triggered | 1 (default) |
| Triggered | 2 (switched) |

TECHNIQUES FOR CHANNELIZATION OF STEREO AUDIO IN HEADPHONES

BACKGROUND

The use of mobile electronic devices for the purpose of watching videos, listening to music, and playing video games continues to increase. In general, these devices are configured with an audio output jack, such as a standard 3.5 mm stereo audio port, that enable users to listen to audio in relative privacy without disturbing those around them. One benefit of having standard audio output ports is that there are numerous types and styles of headphone devices from which to choose. Of these options, earbud-style headphones have become a favored choice for mobile electronic devices as they are lightweight, compact and unobtrusive. Earbuds, unlike other types of headphone devices such as over-the-ear style headphones, are designed to be inserted into an ear canal. In general, each earbud is labeled or otherwise marked in a manner that allows users to differentiate which earbud is intended to be inserted in a right ear and which is intended to be inserted into the left.

Figure 1:
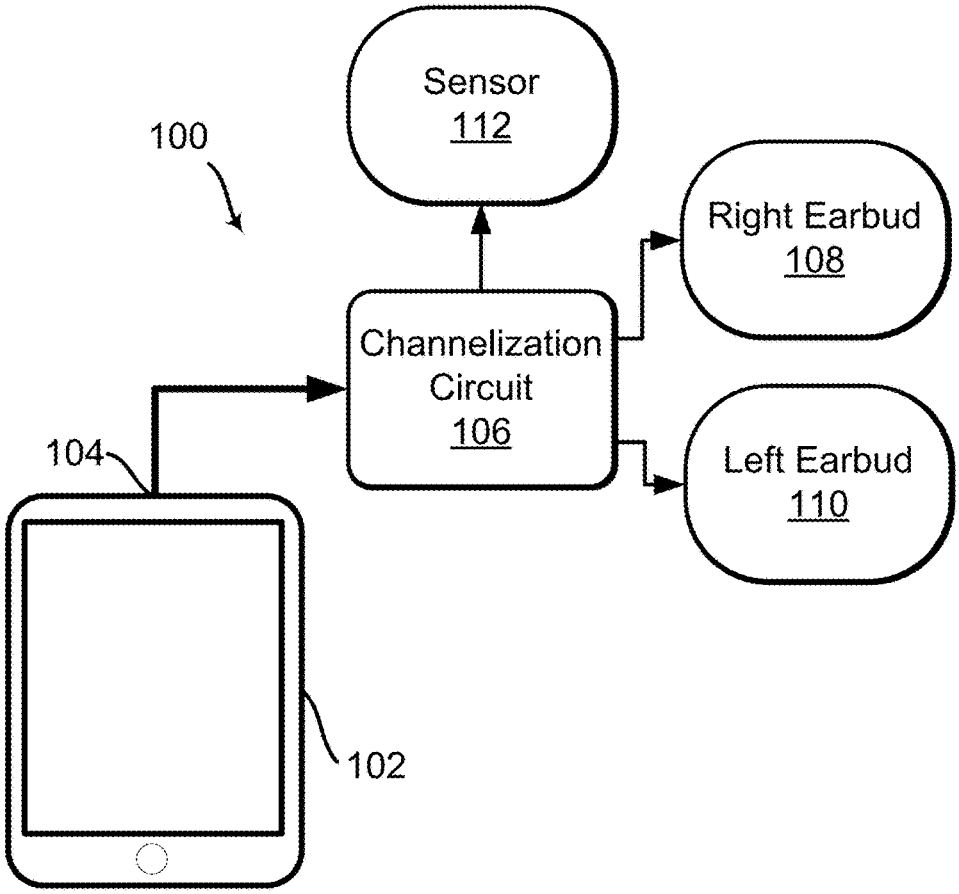
FIG. 1 illustrates a block diagram of an auto-channelization system configured to automatically output a correct stereo audio channel to a user's ear regardless of which ear an earbud is inserted, in accordance with an embodiment of the present disclosure.

These and other features of the present embodiments will be understood better by reading the following detailed description, taken together with the figures herein described. The accompanying drawings are not intended to be drawn to scale. In the drawings, each identical or nearly identical component that is illustrated in various figures is represented by a like numeral. For purposes of clarity, not every component may be labeled in every drawing.

DETAILED DESCRIPTION

Techniques are provided for automatically channelizing a stereo audio signal in a headphone device such that a correct audio channel is output to each ear regardless of which ear an earbud is inserted. The techniques manifest an appreciation that earbuds are generally shaped to comfortably fit in either ear and, as a result, can be inadvertently placed into an unintended ear. Unfortunately, such incorrect placement prevents or otherwise inhibits full and proper enjoyment of stereo audio, as conventional earbuds are configured with a static right and left channel assignment. In an embodiment according to the present disclosure, at least one earbud is configured with a sensor arranged on a housing of the earbud at a position that comes into contact with or is otherwise in detectable range of external anatomy of the ear, such as the tragus or anti-tragus. Once an earbud is inserted, such anatomy not only helps secure the earbuds in place but also can be detected by the sensor thereby enabling the right ear to be differentiated from the left ear. To this end, and accordance with an embodiment, the sensor can be arranged at a position so that the sensor can reliably identify or otherwise indicate a particular ear in which an earbud has been placed. Note that only one earbud needs to be configured with a sensor, as the detection of one ear is sufficient to switch audio channels. In other embodiments, each earbud includes at least one sensor and enables right/left ear detection as well as an indication that each earbud has been inserted. In these cases, the indication earbuds have been inserted, or a lack thereof, enables audio playback to be, for example, paused, stopped, and resumed. In any such cases, the techniques disclosed herein enable a headphone device to dynamically switch audio channels between earbuds based on identifying which ear an earbud has been inserted. So, a user can insert earbuds without conscious regard for whether an earbud is normally configured for a right or left ear as audio channels are intelligently switched to accommodate for ear placement. These techniques are compatible with electronic devices configured with a standard audio output jack, and there is no need for modification of that jack. In a more general sense, the techniques can be used with any jack or interface mechanism, as will be appreciated in light of this disclosure.

GENERAL OVERVIEW

As previously discussed, earphones are typically labeled or otherwise marked in a manner that allows a user to identify which speaker (or earbud) is statically assigned a right audio channel (R) and which speaker is statically assigned a left audio channel (L). However, these markings can be difficult to read (e.g., due to factors such as poor lighting and impaired vision) and can wear-off over time. Generally speaking, and regardless of whether such markings are visible, many people insert earphones without regard for proper ear placement and simply accept the resulting audio performance, and may not even be aware of sub-optimal performance due to incorrect ear placement.

Thus, in accordance with an embodiment, techniques are provided for automatically channelizing a stereo audio signal to output audio channels to a correct ear regardless of which ear an earbud is placed. In an embodiment, the channelization techniques enable an earbud device to receive audio from an electronic device through a standard 3.5 mm audio jack. It should be appreciated in light of this disclosure that that other types of audio jacks can be utilized, and this disclosure is not limited to one particular type of audio output port. For instance, an electronic device may be configured with a so-called "sub-mini" 2.5 mm jack or a larger 6.35 mm jack. The earbud device can use the audio output port of the electronic device to derive a small DC voltage to power a channelization circuit and an associated sensor contained within the earbud housing. Alternatively, or in addition to the power derived from the audio output port, the earbud device may be powered by at least one of a battery and other renewable power sources such as solar cells including within and/or on the earbud housing. Numerous power sourcing schemes can be used as will be appreciated, whether based on scavenged power, dedicated power sources, or a combination thereof. The channelization circuit can be implemented, for example, as a miniaturized switching circuit entirely within an earbud housing of one of the earbuds, wherein the switching circuit is responsive to a detection signal from the sensor. In some cases, the channelization circuit can be distributed such that a portion of the switching circuit (including any wiring) reside in one or more housings along a cord of the earbud device.

In an embodiment, the sensor can be arranged on an earbud at a position that enables a right ear or a left ear to be identified. In some cases, the fleshy prominence on the inner side of the external ear known as the tragus is particularly well-suited for detection by the sensor so as to allow for ear identification. Alternatively, or in addition to the tragus, the small tubercle just above the earlobe known as the antitragus can be detected by the sensor and thus utilized to identify an ear. In any such cases, because the tragus/antitragus of each ear faces an opposite direction, each ear can be detected to the exclusion of the other ear based on this anatomy. Stated differently, a right and left ear largely mirror one another but are different to the extent that natural points of contact for an earbud differ when the same earbud is inserted into a right or left ear. To this end, and in accordance with an embodiment, if the earbud-based sensor is placed in, for example, the right ear, then the sensor will trigger (e.g., because of contact or proximity with the tragus) and cause the switching circuit to switch to its triggered position thereby providing a first channelization scheme that correctly directs sound to the right and left earbuds. On the other hand, if the earbud-based sensor is placed in the left ear, then the sensor will not trigger (e.g., due to lack of contact or proximity with the tragus) and the switching circuit will thus remain in its untriggered position to provide a second channelization scheme that correctly directs sound to the right and left earbuds.

It should be appreciated that earbuds are generally inserted at a same angle in each ear (relative to a cord) to comfortably and securely hold an earbud in place. For instance, earbuds generally include a rigid portion that extends at a 90 degree angle relative to the earbud housing to guide the cord and is designed to allow the earbuds to be easily swiveled in-ear. In this instance, the sensor can be positioned on an earbud at a predefined position that reliably comes in contact or sufficient proximity with a target ear anatomy (e.g., tragus/antitragus) of the right ear, or alternatively, the left ear. For instance, an earbud can include a sensor at a 9 o'clock position (e.g., substantially 90 degrees clockwise from the cord) to detect a tragus of the left ear. Likewise, the same earbud will fail detect a tragus (by design) if placed in a right ear as the sensor would be facing away from the tragus. These specific examples are not intended to limit the present disclosure, and other suitable sensor positions will be apparent depending on factors such as the target ear anatomy being detected, cord placement, earbud size, earbud shape, and other application-specific factors. So, such detection (or lack thereof) can be utilized by the channelization circuit to automatically determine which ear an earbud is inserted and to provide a proper audio channel to each ear accordingly (e.g., a left audio channel to an earbud in a left ear and right audio channel to an earbud in the right ear).

In an embodiment, the channelization circuit includes a switching arrangement that enables channelization of a stereo audio signal to occur only when necessary. For example, and in accordance with an embodiment, the switching arrangement is in a default or first state such that a right audio channel is output to a right earbud and a left audio channel is output to a left earbud. In this example, a left earbud can include a sensor in a position configured to detect the right ear tragus, thereby causing the switching circuit to switch to a switched or second state. Alternatively, a right earbud can include a sensor in a position configured to detect the left ear tragus. In this manner, if the right earbud is inserted into the left ear, the tragus or other targeted anatomy of the left ear can be detected and trigger the switching arrangement to change state. As a result, the switching arrangement can enter change from the default state to the switched state thereby causing the right audio channel to be output to the left earbud and the left audio channel to be output to the right earbud. So, to minimize unnecessary channel switching, a switching arrangement can be configured to only change states in the event an earbud is placed in an incorrect ear. Note a latching type switch can be used to further reduce power consumption associated with the switching process.

Architecture and Operation

FIG. 1 illustrates a block diagram of an auto-channelization system 100 configured to automatically output a correct stereo audio channel to a user's ear regardless of which ear an earbud is inserted, in accordance with an embodiment of the present disclosure. As can be seen, system 100 may include, for example, an electronic device 102, an audio output port 104, a channelization circuit 106, a sensor 112, a right earbud 108 and a left ear bud 110. It should be appreciated that while electronic device 102 is depicted as a smart phone or tablet-based device, it should be appreciated that any electronic device configured to output a stereo audio signal to a jack can be utilized to perform various channelization techniques disclosed herein. For example, the electronic device may be mobile electronic device having a processing system and a mobile power source or supply, such as one or more batteries, for example. Some examples of a mobile electronic device include a personal computer (PC), a laptop computer, ultra-laptop computer, tablet, touch pad, MP3 player, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communications device, and so forth.

As shown, channelization circuit 106 is configured to receive an stereo audio signal via the audio output port 104 and output audio through speakers (not shown) in the right and left earbuds 108 and 110. Although various examples discussed herein include specific reference to a 3.5 mm audio jack, it should be appreciated that electronic device 102 can be configured with numerous other types of audio jacks (e.g., 2.5 mm, 6.35 mm, and so on) and that the type of connector the system 100 utilizes is not limited to a particular type. In an embodiment, audio output port 104 can provide a small source of DC power for the channelization circuit 106 and the sensor 112. To this end, it will be appreciated in light of this disclosure that the channelization circuit 106 can include a power conversion stage (not shown) including an AC to DC converter (e.g., a bridge rectifier) as well as other electrical components to the extent necessary to filter and produce a usable DC voltage. Alternatively, or in addition to the DC power derived from the audio output port 104, channelization circuit 106 and the sensor 112 can be powered by a battery (not shown) or solar cell and battery combination. For example, some Bluetoothenabled earbuds include a battery that can be utilized by the channelization circuit 106 and the sensor 112, as necessary. In any such embodiments, the channelization circuit 106, the sensor 112, the associated power conversion stage, and wiring can be implemented within various form factors. For instance, the channelization circuit 106 can be implemented within the housing/hub of the right earbud 108 or the left earbud 110. In addition, and as discussed above, various portions of the system 100 can be implemented in a distributed manner. To this end, elements of the earbud system 100 can be implemented within one or more earbud housings, along a cord, and/or along a slim housing along the cord of the earphones. It should be appreciated that housing along the cord can have dimensions similar to, for instance, housing conventionally used for volume controls/device functions. In some cases it may be desirable to eliminate or otherwise reduce additional bulk added to headphones implementing the system 100. To this end, placement of circuitry, component size/type, and wiring can be selected to comport with form factor limitations, power requirements, and other application-specific considerations.

In an embodiment, sensor 112 can be implemented as, for example, a proximity sensor, a capacitive touch sensor, a photoelectric (light sensor), or any sensor capable of detecting contact/proximity with anatomy of an ear. In some cases, the sensor 112 can be a low-profile sensor such as the APDS-9130 proximity sensor by Avago Technologies or other equivalent small form factor chip. In some such cases, the proximity sensor can be configured to offer a detection distance in the range of zero (or near zero) to 60 mm. In addition, the proximity sensor may be configured to output an analog or digital signal when indicating proximity to an object or otherwise triggering in response to an event (e.g., placement in the ear). In an embodiment, the sensor 112 can be configured to detect proximity of external anatomy of an ear.

Although the sensor 112 is referred to as a proximity sensor in some specific examples, such reference is not meant to be limiting. For instance, the sensor may also detect direct contact, based on a detection window of the sensor being covered or partially blocked by the target anatomy. Moreover, it should be apparent in light of this disclosure that the sensor 112 can be configured to detect other external portions of the ear such as, for example, the antitragus and any other portions of an ear that make contact with or are otherwise in proximity of an earbud when inserted. To this end, sensor 112 can be positioned and otherwise configured to sense any anatomical feature that will allow for detection of right or left ear placement, as the case may be.

Figure 2A:
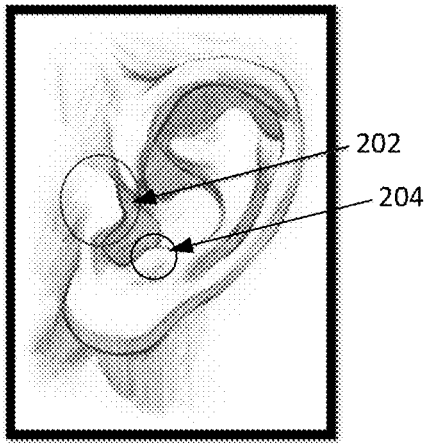
FIG. 2A depicts anatomy of a human ear and some example external regions of the same that can be utilized to automatically channelize the stereo audio signal, in accordance with an embodiment of the present disclosure.

FIG. 2A illustrates the anatomy of a human ear including external regions 202 and 204 of the ear that can be detected by the sensor 112 in accordance with an embodiment of the present disclosure. As shown, the tragus 202 is a prominence on the inner side of the external ear. Also shown, the antitragus 204 is a small tubercle just above the earlobe. Both the tragus 202 and the antitragus 204 assist in keeping earbuds securely in place, and are also detectable portions of the ear anatomy, in accordance with some embodiments of the present disclosure.

Figure 2B:
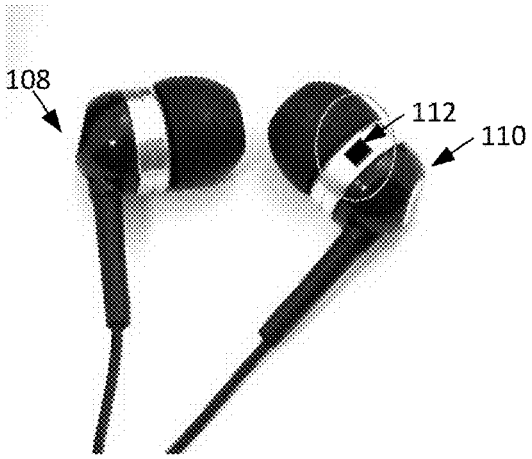
FIG. 2B illustrates one example pair of earphones including a sensor configured to detect ear placement based on the anatomy of the human ear depicted in FIG. 2A, in accordance with an embodiment of the present disclosure.

Referring now to FIG. 2B, with additional reference to FIG. 2A, one example pair of earphones configured with the sensor 112 is depicted. As shown, only the left earbud 110 includes the sensor 112. It should be noted that position of the sensor 112 can vary depending on the target anatomy to be detected, but within the context of the specific example shown in FIG. 2B, the sensor 112 is positioned approximately 90 degrees clockwise from the earbud cord at substantially at a 9 o'clock position, so as to detect the tragus of the left ear. Note that the placement of the cord can be beneficial for determining an optimal position of the sensor 112 as users generally find it comfortable to insert the earbud 112 at an angle whereby the cord extends out between the tragus 202 and the antitragus 204. To this end, consider that when the earbud 110 inserted into the left ear depicted in FIG. 2A, the earbud 110 is held in place, in part, by both the tragus 202 and the antitragus 204. In addition, note that when in the left ear the sensor 112 is covered or otherwise in sufficient proximity of the tragus 202. In an alternative embodiment, and as will be appreciated, the sensor 112 may be positioned on the left earbud 110 to detect the antitragus 204.

Thus, the sensor 112 can detect proximity of the tragus 202, or the antitragus 204 as the case may be, and generate a corresponding signal for the channelization circuit 106 to interpret and switch audio channels, if necessary. Stated differently, and in accordance with one particular example embodiment, if the sensor 112 detects presence of the tragus 202 or antitragus 204, the channelization circuit 106 can interpret the resulting signal (e.g., a positive voltage or other signal indicating a triggered sensor state) from the sensor 112 as an indication that the left earbud 110 is in the left ear. Thus the channelization circuit 106 can channelize a stereo signal such that a left audio channel is output to the left earbud 110 and a right audio channel is output to the right earbud 108. Conversely, and continuing with the example embodiment, if the left earbud 110 is placed in a right ear, the sensor 112 will be on the far side of the left earbud 110 away from the tragus of the right ear. In this instance, the sensor 112 cannot detect the tragus and therefore generates or otherwise outputs a signal (e.g., a substantially zero voltage or other signal indicating an untriggered sensor state) that the channelization circuit 106 can interpret to mean that the left earbud 110 is in the right ear. Thus the channelization circuit 106 can channelize a stereo signal such that a right channel is output to the left earbud 110 and a left channel is output to the right earbud 108. For the sake of completeness and as will be appreciated in light of this disclosure, note that the right earbud 108 can include the sensor 112 and channelization circuit 106 and be utilized to perform various channelization techniques disclosed herein, in a similar fashion to the case where the left earbud 110 includes the sensor 112 and channelization circuit 106.

As previously indicated, the sensor 112 is not limited to detecting only the tragus 202. For instance, and in accordance with another embodiment, the sensor 112 can be configured to detect the antitragus 204 of FIG. 2A. For example, in one such embodiment, the sensor 112 can be positioned at substantially 270 degrees clockwise from the cord at a 3 o'clock position on the earbud 110, so as to detect the antitragus of the left ear. In this instance, the sensor 112 can be positioned at, for example, substantially 270 degrees clockwise from the cord at a 3 o'clock position to detect the antitragus of the left ear. In another such example embodiment, the sensor 112 can be positioned on the right earbud 108 at, for example, substantially 90 degrees clockwise from the cord at a 9 o'clock position to detect an antitragus 204 of the right ear.

In any such sensor position, it should be recognized that placement of the sensor 112 is not meant to be limited by the aforementioned example placement scenarios; rather, these example positions are enumerated to provide an approximate position for the sensor 112 that can enable tragus/antitragus detection, in accordance with some example embodiments. As will be further appreciated in light of this disclosure, there are numerous alternative positions that can be utilized based on factors such as sensor size, cord placement, earbud size, and other application-specific factors. To this end, placement of sensor 112 may be user-configurable or otherwise customizable, in some embodiments. Moreover, it should be noted that not all earbud housings include a round shape (e.g., rectangular, square, star-shaped, custom-shaped). To this end, it should be further appreciated that specific references to degrees/positions of the sensor 112 can be easily translated or otherwise altered to account for variations in earbud housing designs/styles.

In an embodiment, each earbud 108 and 110 can include a sensor 112. In this embodiment, the channelization circuit 106 can utilize output from both sensors to determine ear placement. Such a configuration can be useful not only to determine which ear each of the earbuds 108 and 110 is placed, but also that one or both of the earbuds is not inserted into an ear. Consider by way of example, that some users leave only one earbud in place when listening to audio (e.g. to stay alert to their surroundings). Unfortunately, if the audio is output in stereo, the user will only hear one channel of the stereo audio output. In this instance, the channelization circuit 106 can be configured such that a right and left audio channel are mixed into a mono channel and output to the earbud detected to be in-ear. In another embodiment, the system 100 enables audio to be muted in the event no ear is detected by either earbud. In this instance, the system 100 may unilaterally mute audio independent from the device outputting audio.

In yet another embodiment, the right and left earbuds 108 and 110 can include an optional ambient light sensor (ALS) within an earbud speaker (e.g., in a speaker cone) or otherwise positioned on an earbud to detect that an earbud has been inserted into an ear based on changes in an ambient light pattern (e.g., presence and absence of detectable light). In this embodiment, the insertion of an earbud causes the ALS to be covered and thus detect a change in the ambient light. To this end, the ALS can further benefit channelization schemes generally disclosed herein as channelization can be avoided based on false positives (e.g., sensor 112 detecting a user's hands versus anatomy of an ear) and instead only triggered after an earbud has been inserted into an ear. In any such embodiments, the system 100 can transmit a signal via the cord to an electronic device that pauses, mutes, or otherwise suspends audio playback until an earbud is detected in-ear. In these cases, once an earbud is detected in-ear by the sensor 112, and the optional ALS, another signal could be transmitted to the electronic device that causes audio playback to resume.

In an embodiment, a plurality of sensors may be positioned around the earbud housing of one or both of earbuds 108 and 110. In this embodiment, each of the sensors can be identified based on a predefined position and utilized by the channelization circuit 106 to determine that earbuds are in-ear and/or to discern one ear from the other. For example, consider that the tragus 202 can be detected by a first sensor and the antitragus 204 can be detected by a second sensor which is positioned opposite (180 degrees) from the first sensor. The channelization circuit 106 can utilize a signal from the first sensor and the second sensor to determine, for example, that an earbud is in a particular ear. It should be appreciated in light of this disclosure that a sensor that does not detect portions of an ear may also be intelligently utilized by the channelization circuit 106 to channelize audio output as necessary and/or suspend audio output if one or more earbuds is no longer in-ear. By way of example, consider that each earbud 108 and 110 can include a plurality of proximity sensors arranged around the entire housing of each earbud. In this example, the channelization circuit 106 can intelligently interpret the signals received from the plurality of earbuds to determine such things as, for example, an earbud is in a right ear versus a left, an earbud is outside of an ear, and/or not switching audio because fingers are detected as touching an earbud (based on an irregular number of sensors detecting flesh).

Figure 3:
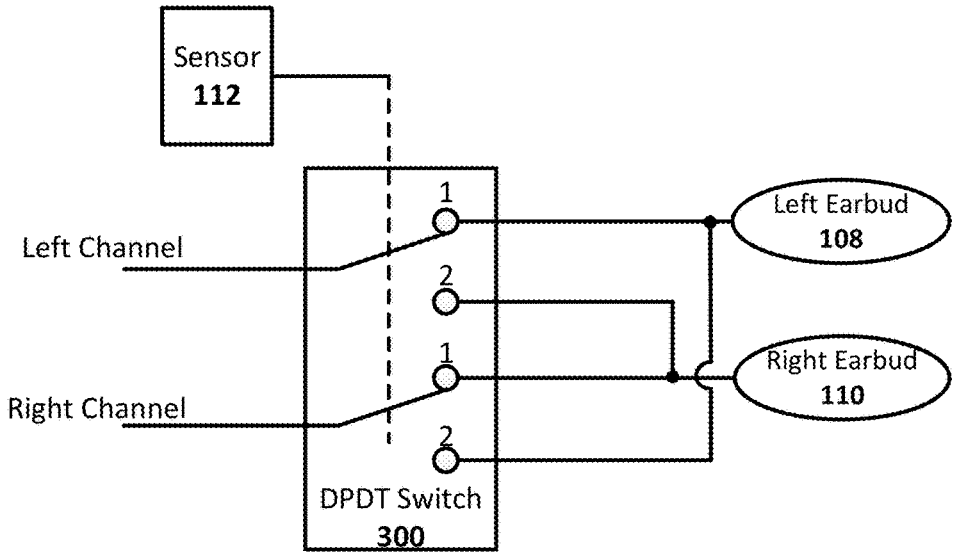
FIG. 3 illustrates a schematic diagram of one example switching arrangement configured to automatically channelize earbud output based on a signal from the sensor of FIG. 2B, in accordance with an embodiment of the present disclosure.

Referring now to FIG. 3, a schematic diagram of one example of the channelization circuit 106 is depicted as comprising a double pole, double throw (DPDT) switch 300, in accordance with an embodiment of the present disclosure. As shown, the DPDT switch 300 is in a default or first state such that a right audio channel is output to the right earbud 108 and a left audio channel is output to a left earbud 110. In some cases, it may be desirable to avoid unnecessary switching operations (and subsequent channelization) when the right and left earbud 108 and 110 are, for instance, not in a user's ears. Likewise, when the right earbud 108 and the left earbud 110 are inserted properly into the right and left ear, respectively, it is unnecessary to switch audio channels. To this end, the DPDT switch 300 remains in its default or first state such that channelization remains consistent (e.g., right audio channel is output to the right earbud 108, left audio channel is output to the left earbud 110). Switching operations of the DPDT will now be explained by way of example. Consider that the right earbud 110 is configured with the sensor 112 arranged at substantially at 90 degrees clockwise from a cord at a 9 o'clock position along the hub/housing of the right earbud. It should be appreciated that with the sensor 112 at substantially the 9 o'clock position, the sensor 112 will detect proximity of the tragus 204 (FIG. 2A) only if the right earbud 110 is inserted into a left ear. Stated differently, position of the sensor 112 on an earbud (e.g., right earbud 110 and left earbud 112) can be such that the sensor 112 only generates a detection signal when the earbud is placed in an incorrect ear. Accordingly, the DPDT switch 300 remains in default or first state until placement of an earbud causes the sensor to 112 to trigger automatic channelization to account for a right earbud being in a left ear, and vice-versa, for instance. Once the sensor 112 detects a tragus (or antitragus, depending on configuration) a signal is generated by the same to trigger the DPDT switch 300 into a switched or second state. Thus, automatic channelization results as the right audio channel is switched to the left earbud 110 and the left audio channel is switched to the right earbud 108. As will be appreciated in light of this disclosure that other circuits can be utilized to perform switching operations disclosed herein, and that this disclosure is not limited in this regard.

Further note that the switching arrangement 300 may be implemented with latching capability, such that power is not required to hold the switch in either the first or second states. For instance, a magnetic field can be used to latch the switch 300 into a state or position after the circuit is energized by the sensor 112 output. Alternatively, in other embodiments, one state of the switch 300 may be held without power consumption (e.g., default state) while the other state is held when the switch is energized or otherwise consuming power (e.g., switched state). As will be further appreciated in light of this disclosure, the degree to which the switch 300 is energized and consuming power can vary from one embodiment to the next, and will depend on factors such as the availability of renewable or scavengable power, the impact on power consumption, expected use-time between charges of media device employing the earbuds, and the desired cost of switch 300.

Methodology

Figure 4:
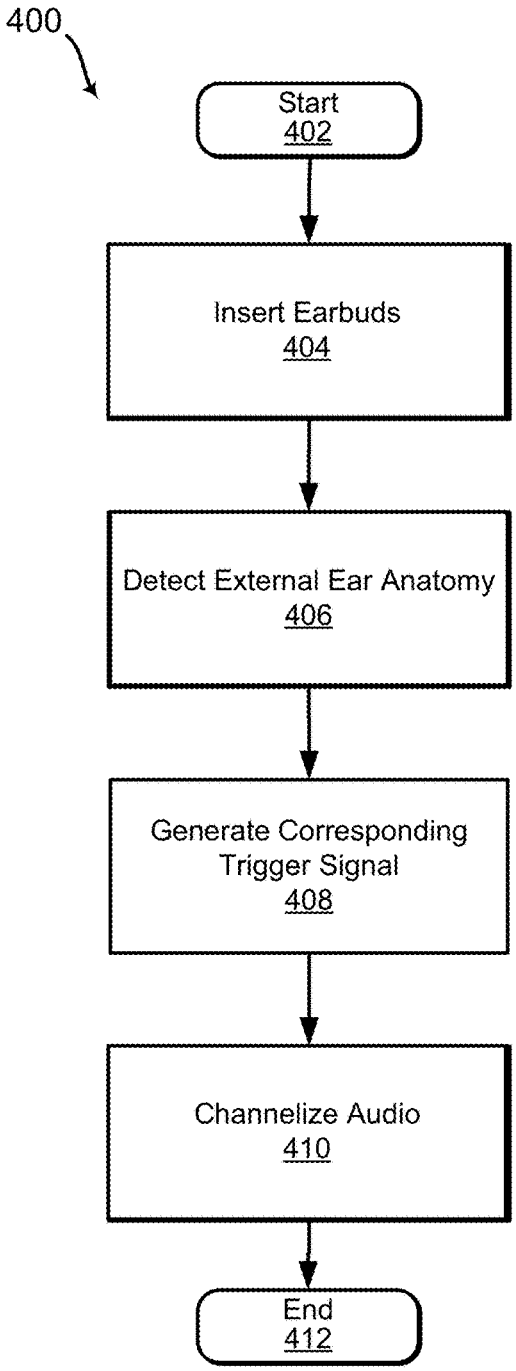
FIG. 4 illustrates an example methodology for determining whether an earbud is in a right or a left ear and channelizing audio output appropriately, in accordance with an embodiment of the present disclosure.

FIG. 4 illustrates an example methodology 400 for detecting whether an earphone is in a right or left ear and channelizing an audio signal accordingly, in accordance with an embodiment of the present disclosure. The method may be implemented, for example, by the channelization circuit 106 of FIG. 1 implemented in the right or left earbud 108 and 110. However, the functionalities provided herein can be carried out in a distributed nature as well, if so desired. For example, some functions can be carried out by hardware within one or both earbuds and/or in housing along a cord. Likewise, while some specific examples include switching logic in specific a DPDT switch configuration, other hardware components in various combinations may be utilized to perform channelization routines variously described herein. Numerous other configurations will be apparent in light of this disclosure. The method begins in act 402.

As can be seen, the method 400 includes inserting earbuds 404 into a right and left ear. As discussed with reference to FIG. 2B, at least one of the right and left earbuds 108 and 110 include the sensor 112. Further, as discussed above with reference to FIG. 3, the sensor 112 can be positioned on the right earbud 108 and/or the left earbud 110 such that a trigger signal is only generated if an earbud is placed in an ear opposite of the output audio channel (e.g., the right earbud 108 in a left ear) and a tragus is detected within proximity of the sensor 112. To this end, in accordance with an embodiment, automatic channelization (e.g., via DPDT switch 300) occurs only when necessary to account for insertion of earbuds in an incorrect ear. For instance, the left earbud 110 can be configured with the sensor 112 arranged at a position that will only detect a tragus/antitragus if inserted into a right ear. Likewise, the right earbud 108 can be configured with the sensor 112 arranged at a position that will only detect a tragus/antitragus if inserted into a left ear. To this end, if an earbud is inserted into to an incorrect ear, the sensor 112 will detect the anatomy of that incorrect ear and generate a corresponding signal to cause audio channels to be switched. In other cases, in accordance with another embodiment, the absence of a tragus within proximity of the sensor 112 can be utilized to switch audio channels to a proper ear. For example, the left earbud 110 can be configured with the sensor 112 arranged at a position that will only detect a tragus/antitragus if inserted into a left ear (e.g., such as the embodiment depicted in FIG. 2B). In this example, if the sensor 112 does not detect the tragus (e.g., because it was inserted in a right ear), the sensor 112 will generate a corresponding signal that causes audio channels to be switched. In any such cases, the sensor 112 provides a trigger signal that can be utilized to channelize audio such that a proper audio channel is output to each ear.

The method continues by detecting external anatomy of the ear 406. As discussed above, such detection can include determining proximity of a tragus/antitragus by the sensor 112, or a lack thereof. In any such case, the sensor 112 generates a corresponding signal 408. The method continues by channelizing audio 410 based on the generated signal. The generated signal can be interpreted by a channelization circuit, such as the channelization circuit 106 of FIG. 1. In some cases, the signal indicates that, for instance, the right earbud 108 is in the left ear. In other cases, the signal indicates that, for instance, the left earbud 110 in the right ear. In any such cases, a switching arrangement, such as the DPDT switch 300 can be actuated in a manner that causes a right audio channel to be output to the left earbud 110 and the left audio channel to be output to the right earbud 108. Of course, if right and left earbuds 108 and 110 are inserted into correct ears, the DPDT switch 300 can remain in its default or first state such that a right audio channel is output to the right earbud 108 and the left audio channel is output to the left earbud 110. The method ends in act 412.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Whether hardware elements and/or software elements are used may vary from one embodiment to the next in accordance with any number of factors, such as desired computational rate, power levels, heat tolerances, processing cycle budget, input data rates, output data rates, memory resources, data bus speeds and other design or performance constraints.

Some embodiments may be implemented, for example, using a machine-readable medium or article which may store an instruction or a set of instructions that, if executed by a machine, may cause the machine to perform a method and/or operations in accordance with an embodiment of the present disclosure. Such a machine may include, for example, any suitable processing platform, computing platform, computing device, processing device, computing system, processing system, computer, processor, or the like, and may be implemented using any suitable combination of hardware and software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of executable code implemented using any suitable high-level, low-level, object-oriented, visual, compiled and/or interpreted programming language.

Further Example Embodiments

The following examples pertain to further embodiments, from which numerous permutations and configurations will be apparent.

Example 1 is an audio output device comprising a right earbud having a speaker, a left earbud having a speaker, a first sensor operatively coupled with one of the right or left earbuds, and configured to sense presence of an anatomical ear feature, and a switching circuit configured to be in a first state responsive to the first sensor indicating presence of the anatomical ear feature, and a second state responsive to the first sensor indicating non-presence of the anatomical ear feature.

Example 2 includes the subject matter of Example 1, where the sensor comprises at least one of a proximity sensor, a capacitive touch sensor, and a photoelectric sensor.

Example 3 includes the subject matter of Examples 1-2, where the sensor comprises a proximity sensor configured with a detection distance within the range from zero to 60 mm.

Example 4 includes the subject matter of Examples 1-3, where at least one of the right earbud and the left earbud include the sensor.

Example 5 includes the subject matter of Examples 1-4, where at least one of the right earbud and the left earbud include the switching circuit.

Example 6 includes the subject matter of Examples 1-5, where the sensor is arranged at a first position, the first position being configured to detect a tragus of a right ear or a left ear, but not both.

Example 7 includes the subject matter of Examples 1-5, where the sensor is arranged at a second position, the second position being configured to detect an antitragus of a right ear or a left ear, but not both.

Example 8 includes the subject matter of Examples 1-7, where the sensor comprises a plurality of sensors.

Example 9 includes the subject matter of Examples 1-8, where the device is configured to couple to an electronic device via an audio jack to receive a stereo audio signal.

Example 10 includes the subject matter of Examples 1-9, where the audio jack comprises at least one of a 2.5 mm, a 3.5 mm, and a 6.35 mm audio jack.

Example 11 includes the subject matter of Examples 1-10, where the switching circuit and the sensor derive power from the audio jack.

Example 12 includes the subject matter of Examples 1-10, where switching circuit and the sensor derive power from a battery of the device.

Example 13 includes the subject matter of Example 12, where the battery is located in housing along a cord of the device.

Example 14 includes the subject matter of Examples 1-10, where switching circuit and the sensor derive power from a solar cell.

Example 15 is a headphone device comprising the subject matter of any of Examples 1-14.

Example 16 is an audio output device comprising a speaker, a sensor coupled to the speaker, and a channelization circuit communicatively coupled to the speaker and the sensor, the channelization circuit configured to identify the speaker is present in a right or left ear based on receiving a signal from the sensor, and channelize a stereo audio signal in response to receiving the signal such that a right audio channel is output to the speaker if the signal indicates the speaker is present in a right ear and output a left audio channel to the speaker if the signal indicates the speaker is present in a left ear.

Example 17 includes the subject matter of Example 16, where the sensor comprises at least one of a proximity sensor, a capacitive touch sensor, and a photoelectric sensor.

Example 18 includes the subject matter of Example 16, where the sensor comprises a proximity sensor configured with a detection distance within the range from zero to 60 mm.

Example 19 is a method for channelizing a stereo audio signal comprising identify an earbud is present in a right or left ear based on a signal from a sensor coupled to the earbud, and channelizing the stereo audio signal such that a right audio channel is output to a speaker of the earbud if the signal indicates the earbud is present in the right ear and output a left audio channel to the speaker of the earbud if the signal indicates the earbud is present in the left ear.

Example 20 includes the subject matter of Example 19, where a housing of the earbud includes the sensor at a first position, the first position being configured to detect a tragus of the right ear or the left ear, but not both.

Example 21 includes the subject matter of Example 19, where a housing of the earbud includes the sensor at a second position, the second position being configured to detect an antitragus of the right ear or the left ear, but not both.

Example 22 includes the subject matter of Examples 19-21, where the signal indicating the earbud is present in the right ear is based on detecting a tragus or antitragus of a right ear in response to the earbud being inserted into the right ear.

Example 23 includes the subject matter of Examples 19-21, where the signal indicating the earbud is present in the left ear is based on detecting a tragus or antitragus of a left ear in response to the earbud being inserted into the left ear.

Example 24 includes the subject matter of Examples 19-21, where the signal indicating the earbud is present in the right ear is triggered based on not detecting a tragus or antitragus of the left ear within detectable range of the sensor.

Example 25 includes the subject matter of Examples 19-21, where the signal indicating the earbud is present in the left ear is triggered based on not detecting a tragus or antitragus of the right ear within detectable range of the sensor.

Example 26 includes the subject matter of Examples 19-25, further including an act of controlling audio playback based on a second signal received from an ambient light sensor, the ambient light sensor being positioned to detect changes in ambient light in response to the earbud being inserted into an ear.

Example 27 includes the subject matter of Examples 19-26, further including an act of determining the earbud is not within either of the right ear or the left ear, and in response thereto, sending a control signal to an electronic device to perform at least one of a pause audio, a stop audio, or a mute audio command.

Example 28 includes the subject matter of Examples 19-26, further including an act of identifying that the earbud is within either the right ear or the left ear, and in response thereto, sending a control signal to an electronic device to resume audio playback.

Example 29 includes the subject matter of Examples 19-26, further including an act of identifying that the earbud is not within either of the right ear or the left ear, and in response thereto, unilaterally muting audio output.

The foregoing description of example embodiments has been presented for the purposes of illustration and description. It is not intended to be exhaustive or to limit the present disclosure to the precise forms disclosed. Many modifications and variations are possible in light of this disclosure.

It is intended that the scope of the present disclosure be limited not by this detailed description, but rather by the claims appended hereto. Future filed applications claiming priority to this application may claim the disclosed subject matter in a different manner, and may generally include any set of one or more limitations as variously disclosed or otherwise demonstrated herein.

What is claimed is:

1. An audio output device comprising:

a right earbud having a first speaker and configured to receive a right audio channel in a first state;

a left earbud having a second speaker and configured to receive a left audio channel in the first state;

at least one sensor operatively coupled with only one of the right or left earbuds and configured to sense presence of an anatomical ear feature, such that the other of the right or left earbuds includes no sensor for sensing presence of an anatomical ear feature; and a switching circuit configured to switch from the first state to a second state in response to the at least one sensor indicating presence of the anatomical ear feature, the right earbud configured to receive the left audio channel in the second state and the left earbud configured to receive the right audio channel in the second state, wherein the switching circuit remains in the first state unless the at least one sensor indicates presence of the anatomical ear feature.

2. The device of claim 1, wherein the at least one sensor comprises at least one of a proximity sensor, a capacitive touch sensor, and a photoelectric sensor.

3. The device of claim 1, wherein the at least one sensor comprises a proximity sensor configured with a detection distance within the range from zero to 60 mm.

4. The device of claim 1, wherein at least one of the right or left earbuds include the switching circuit.

5. The device of claim 1, wherein the at least one sensor is arranged at a first position, the first position being configured to detect a tragus or antitragus of a right ear or a left ear.

6. The device of claim 1, wherein the device is configured to couple to an electronic device via an audio jack to receive the right and left audio channels.

7. The device of claim 6, wherein the audio jack comprises at least one of a 2.5 mm, a 3.5 mm, and a 6.35 mm audio jack.

8. The device of claim 6, wherein the switching circuit and the at least one sensor derive power from the audio jack.

9. The device of claim 1, wherein the switching circuit and the at least one sensor derive power from a solar cell.

10. A headphone device comprising the audio output device of claim 1.

11. An audio output device comprising:

a right earbud including a first speaker and configured to receive a right audio channel in a first state;

a left earbud including a second speaker and configured to receive a left audio channel in the first state;

at least one sensor positioned on an exterior surface of only one of the right earbud or the left earbud, such that the other of the right or left earbuds includes no sensors; and a channelization circuit communicatively coupled to the first and second speakers and the at least one sensor, the channelization circuit configured to remain in the first state unless:

if the at least one sensor is on the right earbud, the at least one sensor detects a left ear, wherein the channelization circuit is configured to switch to a second state whereby the right earbud is configured to receive the left audio channel and the left earbud is configured to receive the right audio channel; or if the at least one sensor is on the left earbud, the at least one sensor detects a right ear, wherein the channelization circuit is configured to switch to the second state.

12. The device of claim 11, wherein the at least one sensor comprises at least one of a proximity sensor, a capacitive touch sensor, and a photoelectric sensor.

13. The device of claim 11, wherein the at least one sensor comprises a proximity sensor configured with a detection distance within the range from zero to 60 mm.

14. A method for channelizing a stereo audio signal for a right earbud and a left earbud coupled to a channelizing circuit, the method comprising:

identifying, by the channelizing circuit, whether an anatomical ear feature is detected based on a signal from at least one sensor operatively coupled with only one of the right or left earbuds; and channelizing the stereo audio signal, by the channelizing circuit, wherein in response to the signal from the at least one sensor indicating that the anatomical ear feature is detected, output a left audio channel to the right earbud and a right audio channel to the left earbud, and otherwise output the right audio channel to the right earbud and the left audio channel to the left earbud.

15. The method of claim 14, wherein a housing of the one of the right or left earbuds includes the at least one sensor at a first position, the first position being configured to detect a tragus or antitragus of the right ear or the left ear.

16. The method of claim 14, wherein the at least one sensor is in the right earbud and the signal indicates the right earbud is present in a left ear based on detecting a tragus or antitragus of a left ear.

17. The method of claim 14, wherein the at least one sensor is in the left earbud and the signal indicates the left earbud is present in a right ear based on detecting a tragus or antitragus of a right ear.

18. The method of claim 14, further comprising:

controlling audio playback based on a second signal received from an ambient light sensor, the ambient light sensor being positioned to detect changes in ambient light.

19. The method of claim 14, further comprising determining the one of the right or left earbuds that includes the at least one sensor is not within an ear, and in response thereto, sending a control signal to an electronic device to perform at least one of a pause audio command, a stop audio command, and a mute audio command.

20. The method of claim 14, further comprising identifying that the one of the right or left earbuds that includes the at least one sensor is within an ear, and in response thereto, sending a control signal to an electronic device to resume audio playback.

* * * * *